United States Patent [19]

Howard

[11] Patent Number: 4,812,604

[45] Date of Patent: Mar. 14, 1989

[54] TORSION SPRING CONTACT SWITCH

[75] Inventor: William A. Howard, Burton, Ohio

[73] Assignee: Delta Systems, Inc., Streetsboro, Ohio

[21] Appl. No.: 131,119

[22] Filed: Dec. 10, 1987

[51] Int. Cl.[4] ..... H01H 13/52

[52] U.S. Cl. ..... 200/260; 200/276; 200/296; 200/300

[58] Field of Search ..... 200/276, 300, 296, 252, 200/257, 260

[56] References Cited

U.S. PATENT DOCUMENTS

| | | | |
|---|---|---|---|
| 2,263,754 | 11/1941 | Batcheller | 200/252 X |
| 3,767,878 | 10/1973 | Sykora | 200/276 |
| 3,895,203 | 7/1975 | Leworthy | 200/276 |
| 4,209,682 | 6/1980 | Rood | 200/276 |
| 4,386,252 | 5/1983 | Kondo et al. | 200/296 |
| 4,473,727 | 9/1984 | Beck | 200/276 |
| 4,694,130 | 9/1987 | Kitzmann et al. | 200/252 X |

*Primary Examiner*—Renee S. Luebke

*Attorney, Agent, or Firm*—Watts, Hoffmann Fisher & Heinke

[57] ABSTRACT

A push button switch assembly. A switch housing supports two parallel conductive switch contacts. A torsion spring wiper member carried by a push button switch actuator selectively bridges the gap between the conductive switch contacts. The torsion spring wiper member is a wire coiled in the middle and having two arms that engage the switch contacts.

9 Claims, 3 Drawing Sheets

30
22
26
112
112
30
24
28
40
30
112
12
42
23a
43
44
60
112
G
13
52
62
62a
43
23a
42
112

11
30a
96
11a
25
52
94
20
31
7
7
30
40
98
62
62a
43
44
23
12
12'

TORSION SPRING CONTACT SWITCH

TECHNICAL FIELD

The present invention relates to a switch assembly having a torsion spring for bridging a gap between switch contacts positioned in a switch assembly housing.

BACKGROUND ART

Electrical switches using push button or plunger type switch actuators have many applications including use in automobile car doors, ignition circuits, refrigerator doors, home appliances and the like. These push button switches are either normally open or normally closed. The push button switch in a refrigerator door, for example, is open when the plunger is forced inward by contact with the refrigerator door. When the door opens, the push button moves to a closed state causing a switch wiper element to bridge the switch contacts and turn the refrigerator light on.

One prior art switch assembly includes spaced apart metal contacts which are selectively bridged by a leaf spring wiper member. In a normally open switch, inward movement of the push button causes the leaf spring to bridge the switch contacts. This also compresses the leaf spring to assure positive engagement of leaf spring contact regions against the two metal switch contacts. In a normally closed switch the push button moves the leaf spring contact regions out of contact with the switch contacts.

Use of the leaf spring as the switch wiper element has certain disadvantages. Prior art leaf spring switch wipers known to applicant are stamped from sheet metal. Stamping the leaf spring is a relatively costly manufacturing step. A V-shaped leaf spring opens and closes in response to push button actuator movement. During the life of the switch, the V-shaped leaf spring is flexed many times and during these flexings, stress forces are concentrated at the apex of the V. This concentration of forces tends to reduce the switch life since prior art leafs tend to fracture over time.

Prior art leaf spring wiper elements must have a certain length to achieve sufficient biasing of the wiper element contact region against the switch contacts. As the leaf spring is repeatedly flexed during the life of the switch, the force of engagement between the leaf spring and the switch contacts tends to diminish so that a margin must be built into the design of the leaf spring. This results in an even longer leaf spring than would be necessary if this degradation with time did not occur.

Some prior art leaf spring contact regions have small extensions or bumps that increase the force of engagement between the metal switch contacts and the leaf spring. This makes the switch more reliable but makes the leaf spring more complex and therefore more expensive.

If the leaf spring bridges the gap between metal switch contacts and currents beyond the rated value of the switch are experienced, the leaf spring may actually be welded to the switch contacts so that the switch can fail in a closed condition. This may be acceptable if the switch is a normally closed switch, but creates a problem if the switch is normally opened and fails in the closed position.

DISCLOSURE OF THE INVENTION

A switch constructed in accordance with the present invention addresses problems experienced with switches having leaf spring wiper members and also exhibits advantageous characteristics unknown in the prior art.

A switch assembly constructed in accordance with the invention includes a housing having an interior region for positioning two conductive switch contacts. The housing carries a push button switch actuator. A biasing member exerts a force on the switch actuator tending to push the actuator to a normal state. The two conductive switch contacts define two spaced apart contact surfaces within the housing. A gap between the two contacts surfaces is bridged by a conductive torsion spring coupled to the push button switch actuator. As the push button actuator moves, the torsion spring acts as a wiper member to either bridge the gap to close the switch, or move away from the gap to open the switch.

In accordance with a preferred embodiment of the invention, the push button actuator defines a torsion spring mounting post. The torsion spring has at least one complete coil that slips over the mounting post to couple the torsion spring to the actuator. Outwardly extending arms of the torsion spring engage the switch contacts.

Use of the torsion spring results in a more efficient contact force than the prior art leaf spring. The coiled segment of the spring applies consistent contact forces over a longer period of time with less stress to the spring. The effective force applied by the spring against the switch contacts can be maintained with a smaller construction due to the coiling of the spring. This results in a smaller switch housing.

The preferred push button actuator and torsion spring mounting post are plastic. Application of excessive current to the switch contacts causes the torsion spring to heat up and melt the mounting post. When the post melts, the torsion spring falls away from the push button actuator and opens the switch since the post melts before the spring can be welded to the switch contacts. This unexpected advantage achievable through use of a coiled torsion spring is a safety feature not provided by the leaf spring construction of the prior art.

A preferred torsion spring is constructed of wire having a generally circular cross section. The rounded contour surface of the torsion spring reduces the switch contact area and therefore results in higher contact forces between the torsion spring and the switch contacts. The increased force of engagement between the torsion spring and the switch contacts produces a better electrical connection without increased manufacturing efforts.

One object of the invention is an improved push button switch having a switch wiper member constructed from a torsion spring. This construction results in improved manufacturability and performance. This and other objects, advantages and features of the invention will be understood from a detailed description of the preferred embodiment of the invention which is described in conjunction with the accompanying drawings.

BEST MODE FOR CARRYING OUT THE INVENTION

Figure 1:
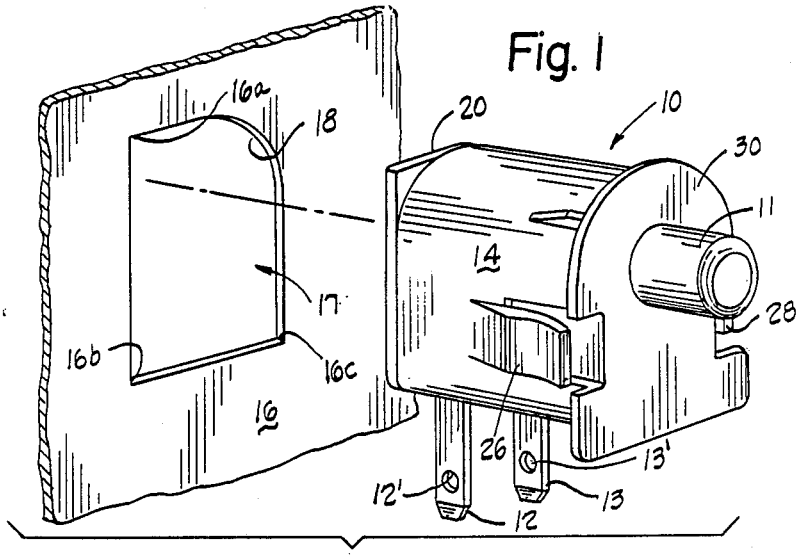
FIG. 1 is a perspective view of a push button actuated switch and a switch mounting panel.
Figure 4:
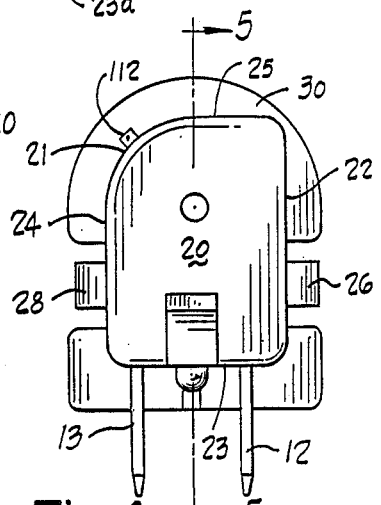
FIG. 4 is an end elevation view of the FIG. 1 push button switch.

Turning now to FIG. 1, a switch 10 constructed in accordance with the invention includes a push button or plunger actuator 11 and two conductive switch contacts 12, 13 carried by a switch housing 14. The housing 14 has two end walls 20, 30 spaced by four generally parallel walls 22–25 (FIG. 4). The housing 14 is specially configured for mounting to a mounting panel 16. An opening 17 in the panel 16 has three relatively sharp (nearly right angle) corners 16*a*, 16*b*, 16*c* and a single rounded or radiused corner 18. A housing end wall 20 also has three sharp corners and a rounded or radiused edge surface 21.

The switch 10 is either a normally closed or a normally open switch. The radiused edge surface 21 of the FIG. 4 housing end wall 20 is for a normally open switch. The panel 16 of FIG. 1 will only accommodate a normally open switch. A normally closed switch has the radiused edge surface on a different corner and will not fit through the opening 17 for a normally open switch.

To mount the switch 10 to the panel 16 the switch contacts 12, 13 are inserted into the opening 17 by tilting the housing 14 at an angle and sliding the contacts though the opening. The housing 14 is then pushed through the opening 17. Two flexible extensions or wings 26, 28 are integrally molded with the walls 22, 24 and are flexed inward as the switch housing 14 is pushed through the panel opening 17. Once the wings 26, 28 pass through the opening 17, they return to their unstressed shape to trap the panel 16 between the wings 26, 28 and an exposed housing end wall 30.

When mounted to the panel 16, the switch contacts 12, 13 are positioned behind the mounting panel 16. The exposed end wall 30 overlaps the panel 16 an amount sufficient to maintain the switch 10 securely attached to the panel 16. The contacts 12,13 form part of a circuit (not shown) that is opened and closed by the switch 10. The contacts 12, 13 define openings 12', 13' to facilitate electrically coupling the contacts to that circuit. A specially configured female connector (not shown) may also be used to connect the switch 10 to a control circuit. The housing end wall 20 defines a tab 31 to allow a latch on the female connector to be securely fastened to the switch housing 14.

The push button or plunger actuator 11 extends through an a circular opening 30*a* (FIG. 5) in the housing end wall 30 and controls the position of a switch wiper member 40 supported within the housing 14. The wiper member 40 selectively bridges the two conductive switch contacts 12, 13 to open and close the switch.

Figure 2:
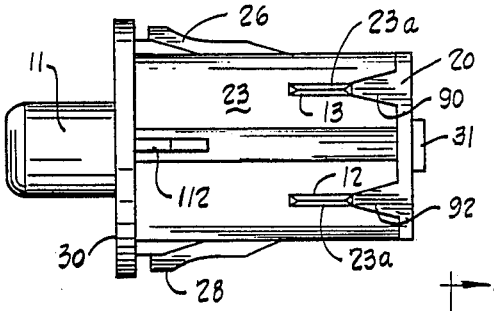
FIG. 2 is a plan view of the FIG. 1 push button actuated switch.
Figure 3:
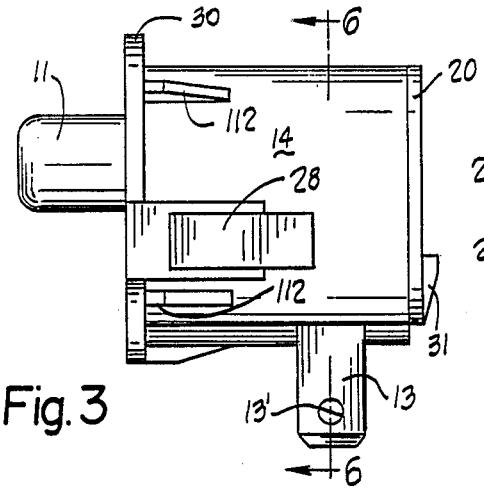
FIG. 3 is a side elevation view of the FIG. 1 push button actuated switch.
Figure 6:
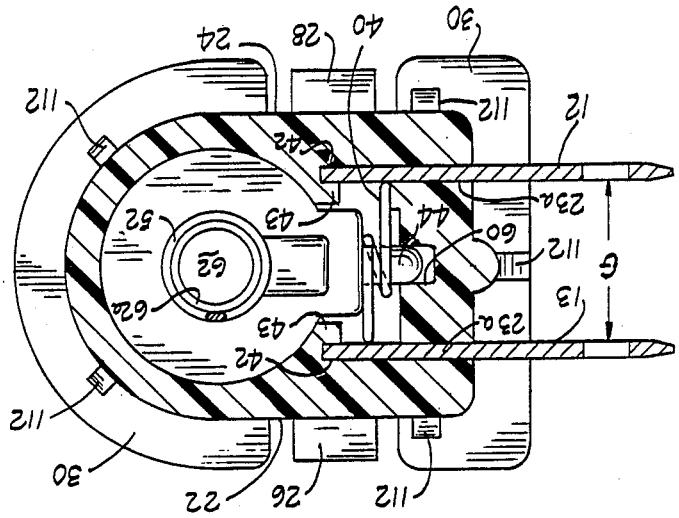
FIG. 6 is a section view as seen from the plane defined by the line 6—6 in FIG. 3.
Figure 5:
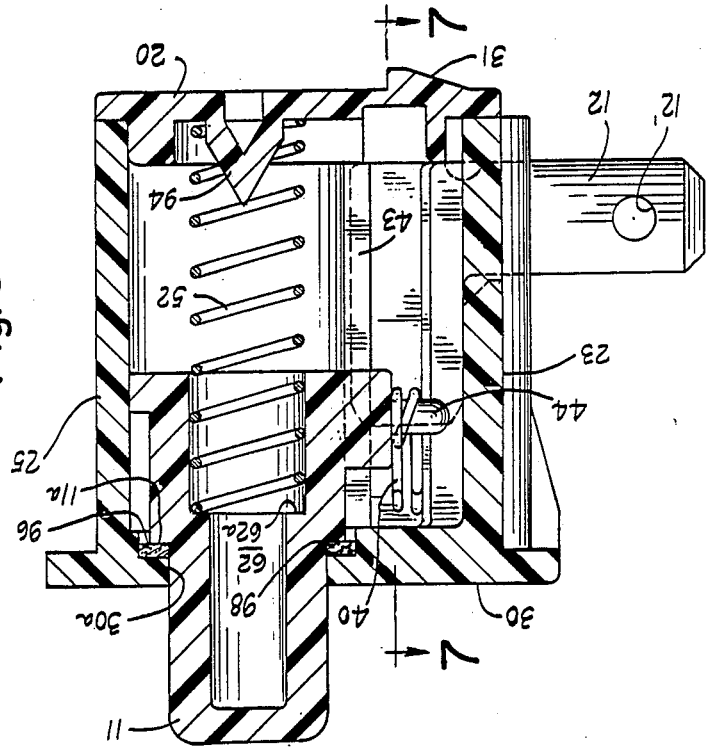
FIG. 5 is a section view as seen from the plane defined by the line 5—5 in FIG. 4.

As seen in FIGS. 2, 5 and 6, the contacts 12, 13 extend through slots 23*a* in the housing wall 23. These slots 23*a* in combination with two grooves 42 defined by ribs 43 in the housing interior orient the contacts 12, 13 generally parallel to each other spaced apart by a gap G.

Figure 10:
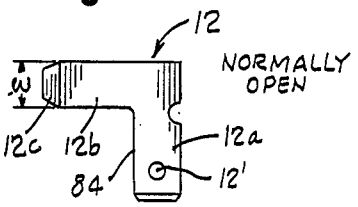
FIG. 10 is an elevation view of a switch contact for use with a normally open switch.

A normally open switch contact 12 is shown in FIG. 10. The contact 12 includes a first segment 12*a* that extends outside the housing 14 and a second segment 12*b* extending away from the first at right angles that is enclosed in the housing 14 when the switch is assembled. The segment 12*b* has a beveled end 12*c* having a narrower thickness. A width W of the contact is approximately the same for both the exposed and enclosed segments 12*a*, 12*b*. The contact 12 is preferably a brass stamping nominally 0.032 inch thick coated with a nickel plating.

The wiper member 40 is carried by an actuator mounting post 44 that moves up and down with the actuator 11. The post 44 is positioned for movement in a guide slot 60 defined by the housing wall 23. The aperture 30*a* through which the actuator 11 extends and guide slot 60 in combination orient the actuator 11 for movement through the housing.

The actuator 11 defines a two-step cylindrical cavity 62 generally coaxial with the housing aperture 30*a* to accommodate an actuator biasing spring 52. The biasing spring 52 has a diameter that fits within a first step of the cavity 62 to contact a shoulder 62*a* defining the stepped portion of the cavity 62. The biasing spring 52 urges the actuator 11 to a fully extended position shown in FIG. 5. To close the normally open switch in FIG. 5, the actuator 11 is pushed inward against the biasing action of the spring 52 to slide the switch contact wiper member 40 along a linear path of travel defined by the housing guide slot 60. In the normally open configuration depicted in FIG. 5, as the actuator 11 is pushed into the housing 14 the wiper 40 bridges the gap between switch contacts 12, 13 and closes the switch.

Figure 7:
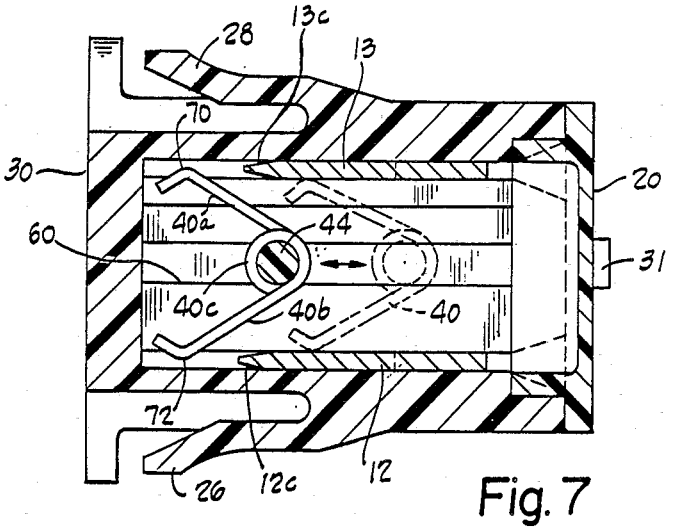
FIG. 7 is a section view of the switch as seen from the plane defined by the line 7—7 in FIG. 5.

FIG. 7 schematically depicts the closing and opening of a normally open switch. The wiper 40 is a tempered brass wire that is generally round in cross section and has a nominal diameter of 0.032 inch. It is bent to define a coil 40*c* that slips over the mounting post 44. Outwardly extending contact engaging arms 40*a*, 40*b* are bent inward at their ends to form outwardly facing switch contact regions 70, 72. As the actuator 11 is pushed into the housing 14 the post moves these contact regions 70, 72 into contact with the beveled regions 12*c*, 13*c* of the metal contacts 12, 13 to close the switch. The wiper coil 40*c* forms a torsional spring. As the actuator 11 moves into the housing 14 the wiper arms 40*a*, 40*b* flex inward to apply a consistent force of engagement against the contacts 12, 13. Inward movement of the push button actuator 11 compresses the biasing spring 52 and stores energy. Release of the actuator 11 allows the spring 52 to push the actuator 11, mounting post 44, and torsional spring wiper 40 back to the normally open state (FIG. 5) to open the switch.

Figure 8:
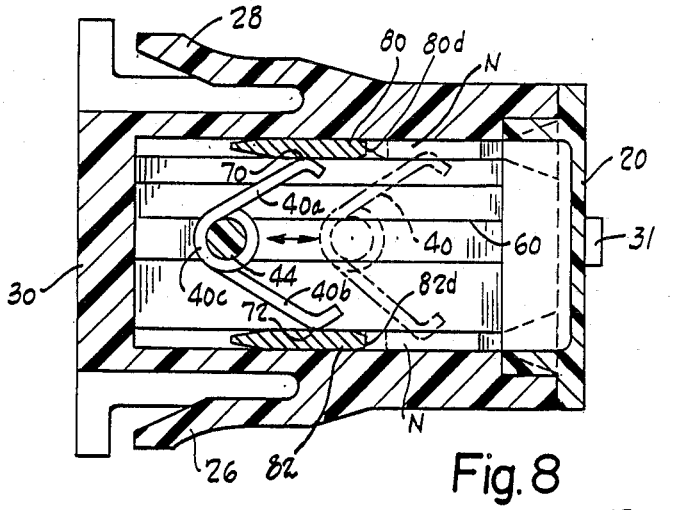
FIG. 8 is a section view similar to the view depicted in FIG. 7 but for a normally closed switch.

FIG. 8 discloses operation of a normally closed switch. The switch wiper 40 normally bridges the gap between two contacts 80, 82 supported within the housing 14. The wiper member 40 is similar to the member shown in FIG. 7 except that the coil 40*c* is mounted to the mounting post 54 with the arms 40*a*, 40*b* extending into the housing toward the end wall 20. With the actuator 11 fully extended by the spring 52 the wiper contact surfaces 70, 72 engage the conductive contacts 80, 82 with a biasing force provided by the coiled portion 40c of the wiper 40.

Figure 9:
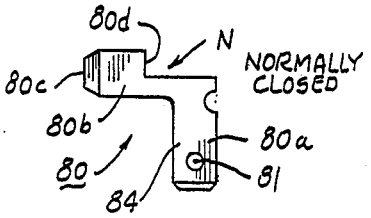
FIG. 9 is an elevation view of a switch contact for use with a normally closed switch.

FIG. 9 illustrates a contact 80 for use with a normally closed switch. As seen in that figure, the contact 80 defines an opening 81, exposed portion 80a and stepped portion 80b having a beveled end 80c mounted within the housing 14. A notch N defined by the stepped portion 80b mounted within the housing provides a structure for opening the switch with inward movement of the wiper 40 in response to actuation of the push button plunger 11. As the plunger 11 moves into the housing 14, the contact surfaces 70, 72 approach the notched portion N of the contacts 80, 82. Continued movement of the wiper 40 through the housing 14 opens the switch 10 as the contact regions 70, 72 move out of contact with the conductive switch contacts 80, 82.

During this inward movement of the wiper 40, the spring 52 (FIG. 5) is compressed to store energy so that when the push button 11 is released, the spring 52 pushes the wiper 40 into contact with slightly beveled edge regions 80d, 82d. The contact surfaces 70, 72 ride up the beveled regions into the gap between the two contacts 80, 82.

As seen most clearly in FIG. 2, the slots 23a in the housing wall 23 widen near the end wall 20. During assembly of the switch, the contacts 12, 13, 80, 82 are inserted into the housing until an edge 84 of the contact (FIGS. 9, 10) engages an end of the slot. Integral with the wall 20 are two fingers 90, 92 which extend into the widened portion of the slots 23a and securely position the contacts 12, 13 inside the housing. The wall 20 also defines a conical spring guide 94 that extends from an inside surface of the end wall 20 to position the spring within the housing. The end wall 20 is fixed to the housing 14 by heat sealing or an adhesive bond.

The push button actuator 11 is generally cylindrical and fits within the housing after the contacts 12, 13 are inserted into the slots 23a. The wiper 40 is mounted to the actuator 11 and the actuator pushed into the housing until a shoulder 11a engages a dust seal 96 fixed within a housing recess 98 defined by the wall 30. A boss 110 integral with the actuator 11 fits between the two ribs 43 and carries the mounting post 44. The actuator 11 and mounting post 44 are plastic and in a preferred embodiment constructed from ABS plastic. In the event a short circuit occurs, high currents pass through the wiper coil 40c and the plunger mounting post 44 melts before the wiper member contact surfaces 70, 72 are welded to the switch contacts 12, 13. When the mounting post 44 melts, the wiper member 40 is in an unstable equilibrium between the switch contacts. Since the arms 40a, 40b are flexed inward energy is stored in the torsional spring. This energy is released and moves the wiper from between the two contacts 12, 13 once the mounting post 44 is no longer in position.

The housing (with the exception of the wall 20) is molded in a single piece. To allow the contacts 12, 13 to be slipped through the panel opening, the housing walls 22–25 do not abut the panel 16. A number of ribs 112 (FIGS. 2 and 6) jut from the walls and engage the panel opening 17 near the wall 30 to secure the switch 10 in place.

The invention has been described with a degree of particularity. While one coil 40c is shown in the drawings, multiple coils can be utilized in the wiper 40. It is the intent that the invention include all modifications and alterations falling within the spirit or scope of the appended claims.

I claim:

1. A switch assembly comprising:

(a) a switch housing defining a housing interior bounded in part by a housing end wall defining a throughpassage into the housing interior;

(b) two conductive switch contacts mounted to the switch housing and defining two spaced apart parallel contact surfaces fixed within the housing interior;

(c) a switch actuator supported within the housing interior for movement along a travel path generally parallel to the parallel contact surfaces of the switch contacts and including an activating portion extending through the end wall throughpassage for actuating the switch;

(d) biasing means positioned within the housing interior to exert a force on the switch actuator tending to move said switch actuator to a normal position with the actuating portion extending beyond an outer surface of the end wall; and (e) an electrically conductive torsion spring carried by the switch actuator for bridging a gap between said contact surfaces, said torsion spring having a coiled center portion contacting said switch actuator and two elongated arms extending from the coiled center portion and bent along their length to form contact regions that slide against said spaced apart parallel contact surfaces as the switch actuator moves along its travel path.

2. The switch assembly of claim 1 wherein the switch actuator includes a plastic torsion spring carrying post that engages the coiled center portion of said torsion spring about an inner circumference and melts if excessive current passes through said torsion spring causing the torsion spring to fall from the actuator and open circuit the two switch contacts.

3. The switch assembly of claim 1 wherein the housing defines resilient mounting tabs and a flange for mounting the housing to a switch support having an opening to accommodate said switch assembly.

4. The switch assembly of claim I wherein the conductive torsion spring comprises a wire having a generally circular cross section.

5. The switch assembly of claim 4 wherein the wire is stainless steel.

6. The apparatus of claim 1 wherein the biasing means normally positions the contact regions of the torsion spring arms out of engagement with the parallel contact surfaces and movement of the actuator along the travel path moves the contact regions of said arms into engagement with said parallel contact surfaces.

7. Switch apparatus comprising:

(a) a switch housing defining an enclosure;

(b) switch contacts supported by the housing and defining two spaced apart metal contact surfaces oriented generally parallel to each other within the enclosure and further defining portions extending through the housing for electrically coupling the switch contacts with an external circuit;

(c) a switch actuator supported by the housing for selectively bridging the metal contact surfaces, said switch actuator including:

(i) a movable actuator positioned in part within the enclosure and having an exposed actuator surface for allowing the movable actuator means to be actuated from outside the housing; and (ii) a torsion spring carried by the movable actuator for movement into a bridging position between said metal contact surfaces, said torsion spring having two arms connected by a coiled center portion for resiliently biasing said arms against said spaced apart metal contact surfaces; and (d) biasing means to bias the switch actuator to a normal position within the housing wherein said arms are in the bridging position between the spaced apart metal contact surfaces to define a normally closed switch.

8. The switch apparatus of claim 7 wherein the switch actuator means comprises a plastic mounting post to support the bridging means inside the housing means.

9. The apparatus of claim 7 wherein the switch contacts define notches such that movement of the torsion spring with the switch actuator moves the two arms out from bridging engagement between the parallel contact surfaces to open the normally closed switch.

* * * * *